United States Patent [19]

Boswell

[11] 3,952,628

[45] Apr. 27, 1976

[54] APPARATUS FOR MANUFACTURING DETONATORS AND RESISTORS

[75] Inventor: George T. Boswell, Springfield, Va.

[73] Assignee: The United States of America as represented by the Secretary of the Army, Washington, D.C.

[22] Filed: Mar. 18, 1974

[21] Appl. No.: 452,478

[52] U.S. Cl. ..... 86/1 R; 29/203 R; 29/610 R; 86/20 R

[51] Int. Cl.[2] ..... C06B 21/00; F42B 33/10

[58] Field of Search ..... 86/1 R, 10, 20 R, 20 A; 102/28, 46; 324/62, 65 CP; 29/203 R, 407, 610, 613; 425/78, 140, 149, 169; 251/29

[56] References Cited

UNITED STATES PATENTS

| | | | |
|---|---|---|---|
| 2,520,394 | 8/1950 | Franzen-Lutz et al. | 324/65 CP |
| 2,806,930 | 9/1957 | Vager | 324/65 CP |
| 2,939,176 | 7/1960 | Adelman | 86/1 X |
| 3,002,457 | 10/1961 | Doughty | 102/28 |
| 3,067,465 | 12/1962 | Giardini et al. | 425/170 |
| 3,109,372 | 11/1963 | Stresau | 86/1 R |
| 3,153,976 | 10/1964 | Lunder | 86/26 |
| 3,303,737 | 2/1967 | Kyle | 86/1 R |
| 3,426,643 | 2/1969 | Dillehay | 86/1 |
| 3,710,241 | 1/1973 | Dineen | 425/169 |
| 3,712,581 | 1/1973 | Parlow | 251/129 |
| 3,742,811 | 7/1973 | Kabik | 86/20 R |

*Primary Examiner*—Harold Tudor
*Attorney, Agent, or Firm*—Nathan Edelberg; Robert P. Gibson; Saul Elbaum

[57] ABSTRACT

An apparatus primarily for the manufacture of detonators in which measurement of the internal electrical resistance of a conductive explosive mixture is made during assembly to determine if the supplied firing energy would initiate said detonator and reject the detonator if the resistance is outside a selected range. During assembly, the apparatus also provides for situations in which the housing is insufficiently loaded, overloaded, or misaligned by recycling or rejecting the detonator assembly whenever said assembly is insufficiently loaded, or rejecting said detonator assembly whenever it is misaligned with respect to the loading compressing mechanism or whenever the detonator housing is overloaded with conductive explosive material. The manufacturing apparatus including the electrical control system which comprises a volume acceptance switch, a maximum pressure switch, and an electrical resistance measurement circuit is designed to produce detonators having uniform firing characteristics.

8 Claims, 3 Drawing Figures

APPARATUS FOR MANUFACTURING DETONATORS AND RESISTORS

RIGHTS OF THE GOVERNMENT

The invention described herein may be manufactured, used, and licensed by or for the United States Government for governmental purposes without the payment to the inventor of any royalty thereon.

BACKGROUND OF THE INVENTION

1. Field of the Invention

This invention relates to electric detonators and, more particularly, to an electric ignition assembly apparatus for the production of electrical explosive detonators having standards of performance and safety, as well as low cost in volume production.

2. Description of the Prior Art

With the development of stringent requirements for performance of explosive devices in both military and commercial applications, a need arose for an apparatus for assembling electrical detonators which would be reliable in operation and which would utilize mechanized production techniques. Thus, the need arose for an assembly apparatus which could produce detonators which were both reliable and reproducible with respect to firing characteristics.

Prior to this invention, no detonator assembly apparatus had been developed which was able to produce reliable and reproducible firing characteristics in the explosive portion of the assembly on a mass production basis. Moreover, such prior apparatus was not able to produce reliable detonator assemblies at reasonable cost.

Prior to this invention, no detonator had been developed which was able to meet reproducible firing requirements on a mass production basis. This was primarily because satisfactory apparatus for assembling such detonators was not available.

Electric detonators of the conventional type are ignition assemblies which comprise a pair of parallel electric conductors extending into the shell from an external firing circuit, a plug of rubber like composition holding the conductors in place and sealing the initiator, a bridge wire connecting the ends of the conductor within the shell, and a heat sensitive ignition composition in contact with the bridge wire. This bridge assembly and installation more than doubles the cost of comparable non-bridge mechanical detonators. For years attempts have been made to construct a low energy electrical detonator with a conductive explosive mixture or pyrotechnic mixture to eliminate the wire bridge. To achieve this many combinations of materials have been tried. The failures that persist are due to the close tolerance that must be maintained between the no fire and the fire requirements. Prior to this invention the assembly process used in the manufacture of conventional detonators comprised the loading of the conductive explosive or pyrotechnic mixture by a predetermined ram pressure technique. Using this technique, an internal electrical resistance measurement is made to determine whether or not the required firing energy would initiate the detonator.

It is accordingly an object of this invention to provide a detonator loading apparatus which permits the pressure ram to be controlled in such a manner as to permit the desired performance of the conductive explosive mixture or pyrotechnic material compressed therein.

It is accordingly another object of this invention to provide an apparatus for manufacturing detonators having ram pressure controlled by the electrical resistance of the conductive explosive or pyrotechnic mixture.

It is also an object of this invention to provide an apparatus for manufacturing detonators having a ram travel control with mechanisms for recycling or rejecting insufficiently loaded detonator housings and a mechanism for rejecting overloaded or improperly aligned detonator housings.

Further objects and the entire scope of the invention will become more fully apparent in the following detailed description and in the appended claims.

SUMMARY OF THE INVENTION

The apparatus for manufacturing electric detonators comprises means for feeding loaded detonator housings into the apparatus, means for testing the conductive explosive composition in the housings, a ram for compressing the conductive explosive composition into the detonator housings, and an electrical means for controlling the pressure exerted by the ram, said electric means being controlled and actuated by electrical resistance measurements of the conductive explosive composition as it is being compressed by the ram. If the ram pressure should exceed the maximum designed pressure due to excessive conductive explosive composition within the housing or misalignments of the parts, the apparatus provides a maximum pressure switch for turning off power to the ram. This maximum pressure switch also actuates a reject mechanism by which that particular housing is removed and another is positioned for compression. The apparatus also provides that should insufficient conductive explosive composition be present, a member connected to the ram causes a volume acceptance switch to open and thereby open the power circuit to the ram and at the same time activate a recycle mechanism or the rejection mechanism. This recycle mechanism provides for the loading of additional conductive explosive composition in the insufficiently filled detonator housing.

BRIEF DESCRIPTION OF THE DRAWINGS

The specific nature of the invention as well as other objects, aspects, uses, and advantages thereof will clearly appear from the following description and from the accompanying drawing in which.

DESCRIPTION OF THE PREFERRED EMBODIMENT

Figure 1:
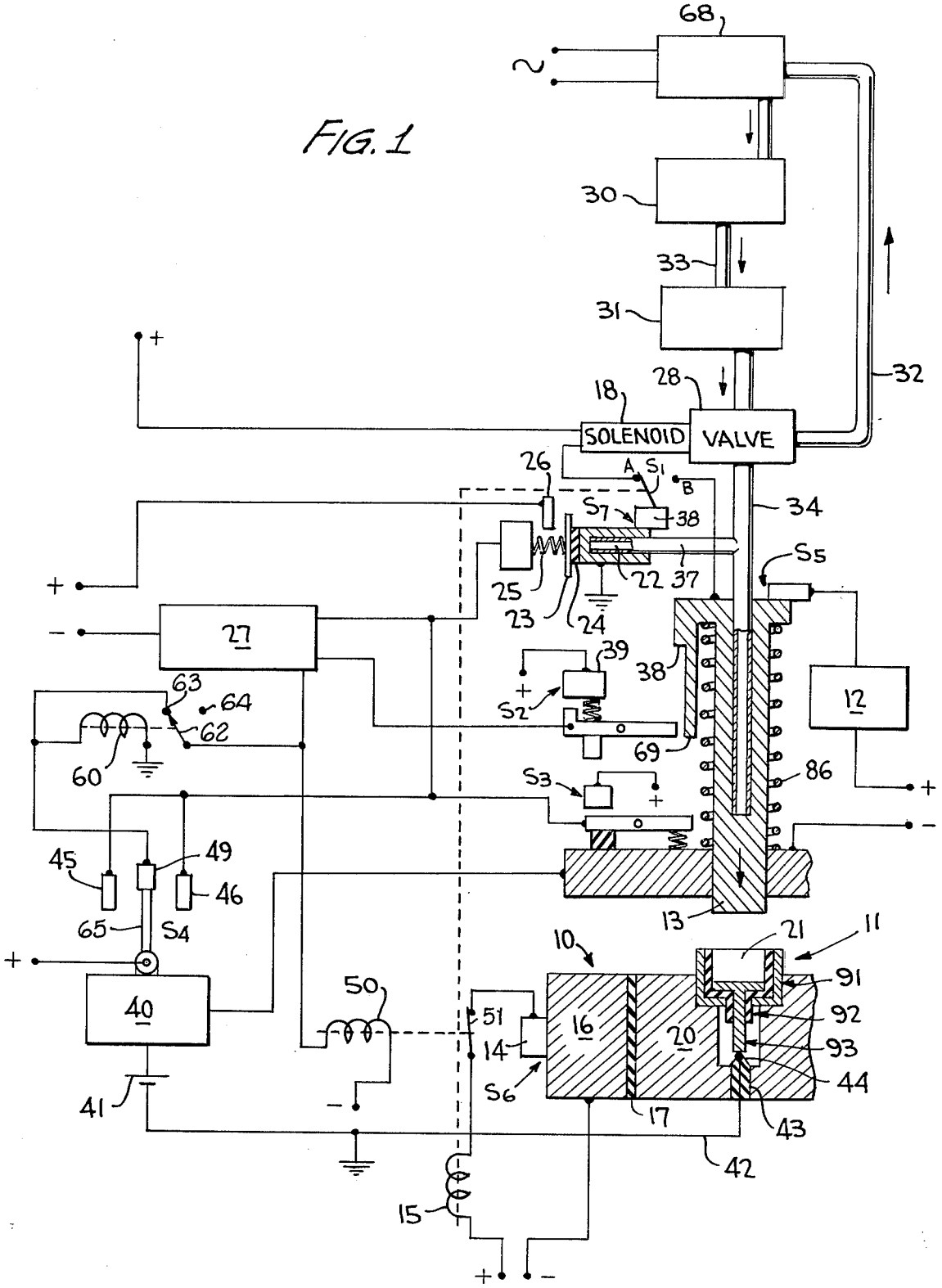
FIG. 1 is a diagram of the apparatus for manufacturing electric detonators.

Referring to FIG. 1, the filling station 10 for the detonator 11 is moved by fixture transfer servomotor 12 beneath the ram 13. This movement of the station 10 is actuated by switch $S_5$ being closed causing current to flow through fixture transfer servomotor 12. The filling station 10 by moving into position under ram 13 closes the switch $S_6$ and actuates solenoid 15. Solenoid 15 causes switch $S_1$ to move to position A. Current is now permitted to flow through switch $S_1$ solenoid 18, member 60, chamber 22 to ground and opens valve 28 to valve 31 to allow flow of fluid to ram 13.

Filling station 10 is divided into several parts. Among these are conductive block 16 and conductive block 20. Both conductive blocks 16 and 20, are electrically insulated by means of insulator 17. The purpose of this feature is to isolate the switch 14 from the electrical measurements taking place at the detonator assembly 11 block 20.

Again referring to FIG. 1, as ram 13 compresses the conductive mix 21 into the detonator assembly 11, fluid chamber 22 slidably mounted on conduit 37 fills up, moves to the left in FIG. 1 and causes switch $S_7$ to disengage solenoid 18 by breaking contact with member 38 and making contact at member 26. By deactivating solenoid 18, valve 28 is closed to allow fluid in ram 13 to flow through conduit 32 and the ram raises by the action of spring 86. Contact element 23 mounted between insulator 24 and spring 25 contacts 26 and thereby permits current to flow through rejection servomotor 27. Rejection servomotor 27, in turn, causes the filling station 10 to move from under ram 13 until switch $S_5$ closes when ram 13 is totally retracted. When switch $S_5$ closes servomotor 12 moves another filling station into place under ram 13. This rejection servomotor actuation occurs when the hydraulic pressure in fluid chamber 22 exceeds a prespecified and desired value based on the tension of spring 25. This build-up of pressure will result when there is too much composition 21 in the detonator housing 11 or when the ram contacts the top of the detonator housing because of misalignment.

Figure 2B:
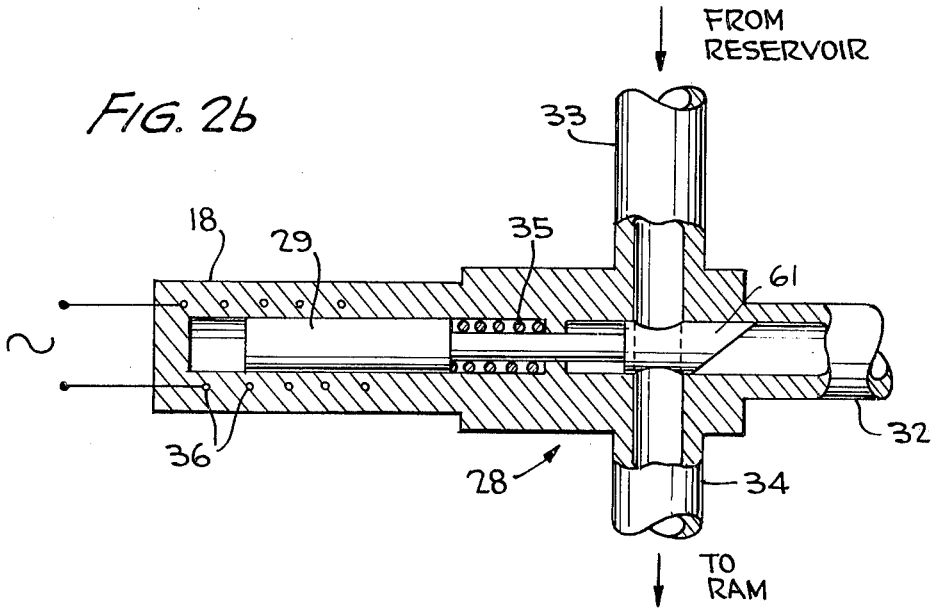
FIG. 2*b* is a cross sectional illustration of the ram pressure and return control valve and solenoid assembly in release.
Figure 2A:
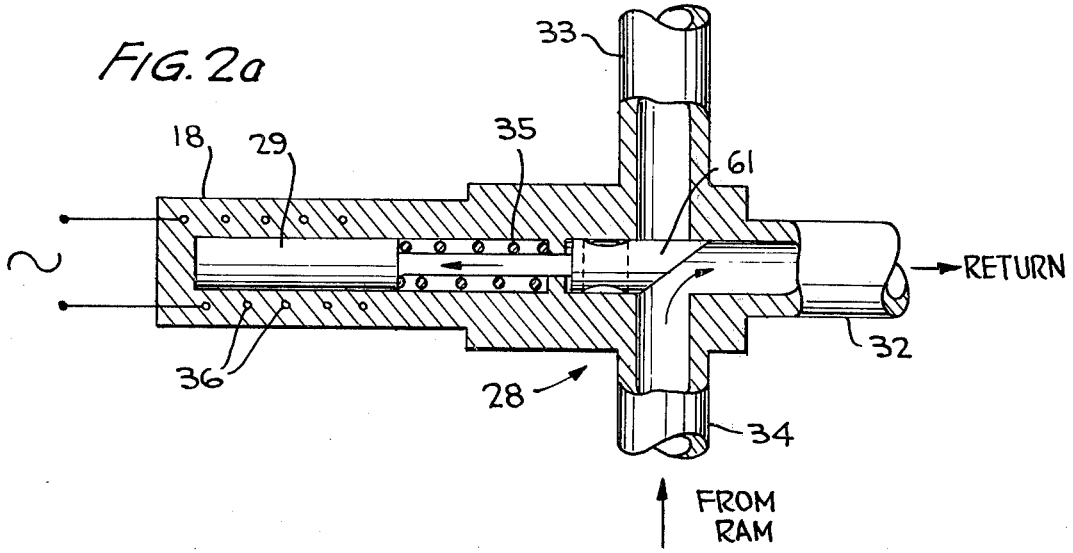
FIG. 2 *a* is a cross sectional illustration of the ram pressure and return control valve and solenoid assembly in compression.

Referring now to FIGS. 2*a* and 2*b*, the solenoid 18 is shown with details of its structure. The valve of the solenoid, shown generally at 28 in FIG. 2*a*, is opened by moving the core 29 to the right. This operation moves the member 61 and allows fluid from the high pressure reservoir 30 created by the pump 68 to enter the ram via pipe 33. Movement of the solenoid valve member prevents return of fluid to the reservoir 30 (see FIG. 1). Once the power to the solenoid windings is cut off, spring 35 returns the core 29 and member 61 to the normally closed position illustrated in FIG. 2*a* to allow the fluid to flow from the ram 13 and pipe 34 to pipe 32 and pump 68.

Returning to FIG. 1, the ram 13 is forced downward by the pressure of the fluid overcoming the compression force of the spring 86. Ram velocity is manually set by the adjustable valve 31. Initial movement of the ram 13 opens switch $S_5$, and thereby opens the circuit for the fixture transfer servomotor 12.

As the ram 13 consolidates the conductive explosive mix 21, and provided the volume of the conductive explosive mix 21 is not excessive, a lip 38 on the ram 13 actuates switch $S_2$ and closes a second circuit of the rejection servomotor 27 to the contact 39. This second circuit will power relay 50 in response to a rejection signal from switches $S_3$ and $S_4$ as explained hereafter.

If the ram 13 sufficiently consolidates the conductive explosive mix 21, current from the battery 41 flows through the mix 21 via the meter 40, ram 13 and wire 42. Surrounding wire 42 beneath the detonator 11 is an insulator plug 43 having an electrical contact 44 on the top thereof. The current flowing through the mix 21 from battery 41 is measured by means of current meter 40. This measurement gives an indication of the resistance valve of the mix 21.

When the current value reaches a prespecified maximum or minimum as signified by switch $S_4$ having arm 65 contacting either contact 45 or 46, current is supplied to the rejection servomotor 27 and the detonator 11 is rejected by the same sequence as described above for excess of mix 21 or misalignment except that switch $S_1$ is moved to contact B by solenoid 50 deactivating solenoid 15.

When movement of the fixture 10 occurs as a result of completion of a test or upon rejection, the solenoid circuit at the contact 14 is opened deactivating solenoid 15 and consequently solenoid 18. The spring 36 (see FIG. 2*b*) forces the valve 28 (FIG. 1) shut and thereby releases pressure to ram 13. When rejection servomotor 27 is powered by switch $S_4$ after switch $S_2$ is closed, this powers relay 50 which opens switch 51 in solenoid 15 circuit. Consequently solenoid 18 is deactivated and spring 86 causes the ram 13 to retract. If the sweep switch $S_4$ maintains contact on the middle of the limits set by contacts 45 and 46, i.e., if the contactor 65 of $S_4$ maintains contact with contactor 49 long enough for time delay relay 60 to move switch arm 62 from contact 64 to 63 to actuate solenoid relay 50, solenoid 18 is deactivated due to solenoid 15 releasing switch $S_1$. This causes the ram to retract whereby switch $S_5$ is closed and fixture transfer servomotor 12 is powered to advance fixture 10. By using time delay relay 60 in combination with the meter circuit to control the ram 13, the resistance can be maintained within an acceptable range by varying the degree of compactness of a quantity mix 21 within a given range.

Should there be insufficient volume of mix 21 in the detonator assembly 11, switch $S_3$ is closed by lip 69 on the ram 13. This causes power to flow to the rejection servomotor 27 and the detonator assembly is rejected. The signal from switch $S_3$ may be used to activate a recycling mechanism (not shown) instead of the rejection servomotor 27. Actuation of servomotor 27 by $S_3$ after the switch $S_2$ is closed also actuates relay 50 which deactivates solenoid 18 by contact of $S_1$ at B. This causes the ram to rise.

The detonator assembly 11 comprises two electrical contacts. One is the case 91, the other is the terminal 93. The two contacts are electrically isolated from each other by means of an insulator 92.

The inventor wishes it to be understood that he does not desire to be limited to the exact details shown herein for obvious modifications will occur to a person skilled in this art.

What is claimed is:

1. An apparatus for assemblying electronic detonators wherein a mass of pyrotechnic composition is loaded into a housing and compressed by a ram, and including an electric means for controlling movement of said ram, the improvement which comprises:

first means electrically connected to said mass during compression for detecting the instant at which a predetermined electrical resistance of said mass has been attained;

second means for simultaneously sensing when said ram is at a predetermined maximum travel distance, indicating insufficient volume of pyrotechnic composition in said housing; and third means interconnecting said first and second means to said electric means for causing said electrical means to terminate compression by said ram at said instant of predetermined electrical resistance and for insufficient volume.

2. The apparatus of claim 1 further comprising fourth means connected to said ram for preventing said ram from exceeding said predetermined maximum travel distance and said second means is responsive to said fourth means for sensing when the ram is at said maximum distance.

3. The apparatus of claim 1 wherein said first means comprises:

fifth means connected to said mass for supplying constant current across said mass;

sixth means connected to said mass for monitoring voltage across said mass; and seventh means connected to said sixth means and said third means for detecting when said monitored voltage is within a given range and thereby causes said third means to terminate compression by said ram.

4. The apparatus of claim 1 wherein said electric means is a solenoid controlled valve, a source of pressurized fluid is connected on one side of said valve and said ram is connected to the other side of said valve, and said third means is a switch which controls the activation-deactivation of said solenoid.

5. The apparatus of claim 4 including eighth means connected between the ram and said valve for detecting a predetermined back pressure of said fluid, indicating misalignment of said housing relative to said ram or an overload of pyrotechnic composition in said housing, and said eighth means is connected to said third means to cause said third means to terminate compression by said ram when misalignment or overload of composition is indicated.

6. In an apparatus for assemblying electronic detonators of the type wherein a mass of pyrotechnic composition is loaded into a housing and compressed by a ram, and including an electric means between a source of pressurized fluid and said ram for controlling exerted pressure used to compress said mass to a predetermined pressure, the improvement which comprises:

means electrically connected to said mass during compression for detecting the instant at which a predetermined electrical resistance of said mass has been attained;

means for detecting insufficient pyrotechnic composition in said housing means during compression;

means for detecting misalignment of said housing relative to said ram during compression;

means for detecting an overload of composition in said housing during compression; and means interconnecting all of said detecting means and said electric means for causing said electric means to terminate compression by said ram upon a detected condition by any of said detecting means.

7. The apparatus of claim 6 including means connected to all of said detecting means for rejecting the housing upon detection by any of said detecting means.

8. In an apparatus for assemblying electronic resistors of the type wherein a mass of resistive composition is loaded into a housing and compressed by a ram, and including an electric means between a source of pressurized fluid and said ram for controlling exerted pressure used to compress said mass to a predetermined pressure, the improvement which comprises:

means electrically connected to said mass during compression, for detecting the instant at which a predetermined electrical resistance of said mass has been attained;

means connected between said ram and said electric means for detecting a predetermined back pressure of said fluid during compression, indicating misalignment of said housing relative to said ram or an overload of resistive composition in said housing; and means interconnecting both of said detecting means and said electrical means for causing said electric means to terminate compression by said ram upon a detected condition by either of said detecting means.

* * * * *